US005469660A

United States Patent [19]

Tamenne

[11] Patent Number: 5,469,660

[45] Date of Patent: Nov. 28, 1995

[54] SELF-RESTORING RAILROAD HIGHWAY CROSSING GATE DEVICE

[76] Inventor: Harry L. Tamenne, 3811 Kentland Dr., Roanoke, Va. 24018

[21] Appl. No.: 179,343

[22] Filed: Jan. 10, 1994

[51] Int. Cl.[6] ..... E05D 15/52

[52] U.S. Cl. ..... 479/192; 49/49

[58] Field of Search ..... 49/192, 49, 35, 49/34, 9

[56] References Cited

U.S. PATENT DOCUMENTS 1,271,877 7/1918 Farman ..... 49/192 X
1,665,157 4/1928 Dahnke ..... 49/192 X
1,812,559 6/1931 Sampson ..... 49/192 X
2,657,486 11/1953 Sweetser ..... 49/49 X
4,897,960 2/1990 Barviner et al. ..... 49/192 X

*Primary Examiner*—Philip C. Kannan
*Attorney, Agent, or Firm*—Donavan Lee Favre

[57] ABSTRACT

This is a device which will be part of a railroad highway crossing gate system to prevent gate-arms from being knocked out of their support members by contact with vehicles either by accident or on purpose. The device will allow the gate-arm to be pushed out of position with the traffic flow and return to its normal position when released by the vehicle in contact.

1 Claim, 4 Drawing Sheets

SECT. C-C

SECT. A-A

SECT. B-B

NORMAL POSITION

DISPLACED POSITION

SECTION D-D

SELF-RESTORING RAILROAD HIGHWAY CROSSING GATE DEVICE

BACKGROUND OF THE INVENTION

1. Field of the Invention

This invention is designed to replace what is now known in the Railroad Industry as the "Breakaway" railroad highway crossing gate.

2. Prior Art

When a railroad highway crossing gate system is activated due to the presence of an approaching or work train shunting the track circuit, the gate-arm is driven down from a vertical to a horizontal position by the Mechanism 17 through its operating arms 18. When down, the gate-arm takes a horizontal position across and perpendicular to the highway. The "Breakaway" Gate is designed to break away from its "holder" when enough pressure is applied through contact with vehicles either deliberately or by accident. This break-away feature is accomplished through the use of shear pins which normally hold the gate-arm 20 in place. When the shear pins shear, the gate-arm falls to the ground. While the gate-arm is on the ground, it may sustain damage before it can be reinstalled sometime later by maintenance personnel. Also, while the gate-arm is on the ground, the crossing is presumed unsafe since the gate-arm system was installed for safety reasons. In addition, while the gate-arm is on the ground it could be damaged beyond repair and must be replaced with a new gate-arm along with the cost of time and labor to restore the arm to the crossing system.

SUMMARY OF THE INVENTION

The purpose of this invention is to provide a way by which a railroad highway crossing gate-arm will remain intact when pressure is applied by a vehicle in contact with it.

This device will allow the gate-arm to be pushed out of its normal position and restore itself when released by the vehicle in contact. This will reduce maintenance costs and improve public safety.

DETAILED DESCRIPTION

Figure 1:
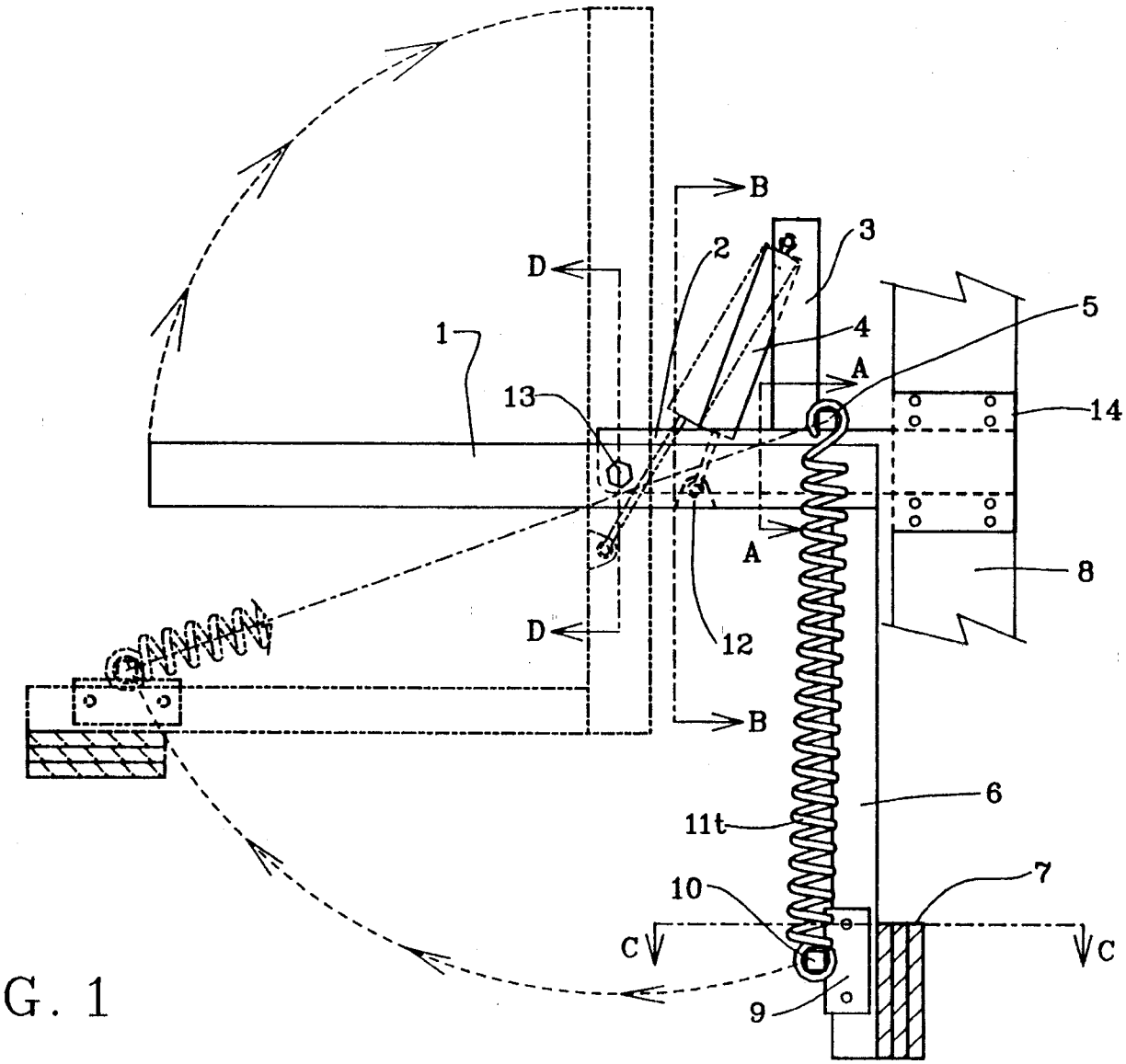
FIG. 1 is a top plan view of the embodiment of the invention showing the normal down position along with the maximum displacement shown as a phantom dotted line view.
Figure 2:
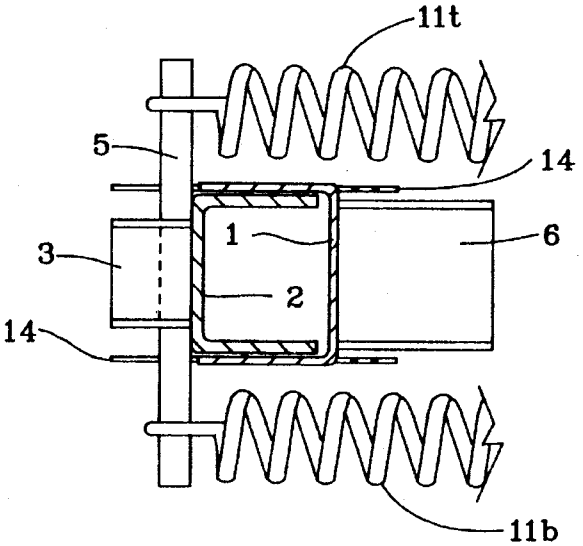
FIG. 2 is a view taken along section line A—A in FIG. 1 showing the upper and lower restoration Springs, 11*t* and 11*b*, anchored at one end to the common stationary anchor post 5.

In FIG. 1 the members 1,2,3 and 6 are fabricated steel channels with the Spring and Weight Channel 6 welded to the Gate-arm Support Channel 1 and the Buffer Support Channel 3 welded to the Main Support Channel 2. These welded units are then attached by the Pivot assembly 13 which allows the Unit 6 and 1 to rotate to a maximum position shown in FIG. 1 as dotted lines. The Main Support Channel 2 is bolted to an Adapter 8 by means of steel plates 14 which are welded to the Main Support Channel 2. The upper and lower restoration Springs 11*t* and 11*b* FIG. 2 are manufactured as closed springs. One end of each Spring 11*t* and 11*b* is anchored to a common stationary post 5 which is welded to the Main Support Channel 2.

Figure 3:
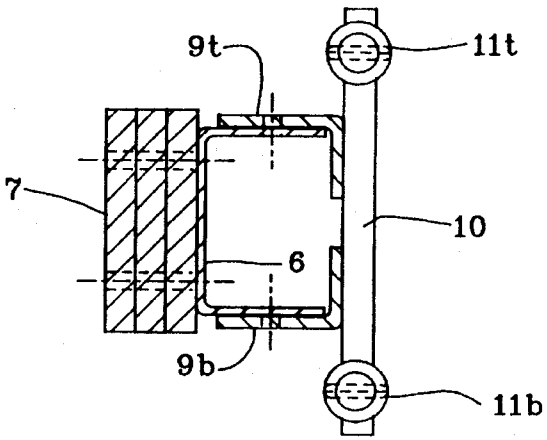
FIG. 3 is a view taken along section line C—C in FIG. 1 showing the Shuttle Assembly 9 and Spring Anchor Post 10 which is common to both upper 11*t* and lower 11*b* springs for anchoring the opposite ends of the springs. This view also includes the weight system 7.

The opposite end of the Springs 11*t* and 11*b* are attached to the Post 10 FIG. 3. This post is welded to the angles 9*t* and 9*b* forming the Shuttle Post Assembly 9. The Shuttle 9, FIG. 1 is moved along the Spring and Weight Channel 6 stretching the closed Springs 11*t* and 11*b* to a predetermined position where the Shuttle 9 is bolted in place on the spring and Weight Channel 6. This action pre-loads the Springs and holds the Gate-arm Support Channel 1 in its normal position snug against the Main Support Channel 2.

Figure 4:
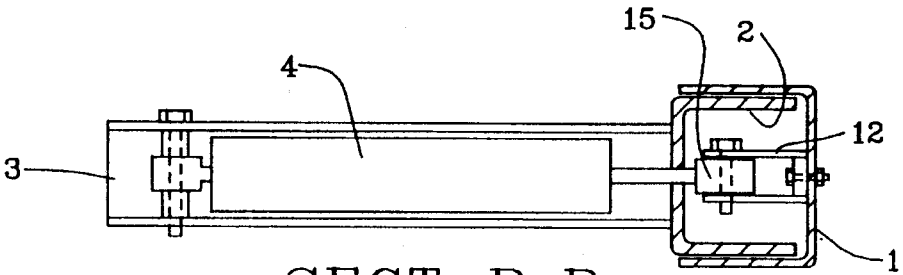
FIG. 4 is a view taken along section line B—B in FIG.1 showing the hydraulic buffer and its relative position in the embodiment of the invention.

In FIG. 4 the Hydraulic Buffer 4 is anchored,through an opening in the Main Support Channel 2, to the Clevis Bracket 12 which is bolted to the Gate-arm Support Channel 1. The opposite end of the Buffer 4 is anchored to the Buffer Support Channel 3 by a cotter-keyed bolt using spacers to center the Buffer in the Buffer Support Channel 3. The Buffer will extend freely when the gate-arm is pushed out of its normal position but the speed restoration is restricted to prevent damage to following vehicles.

Figure 5A:
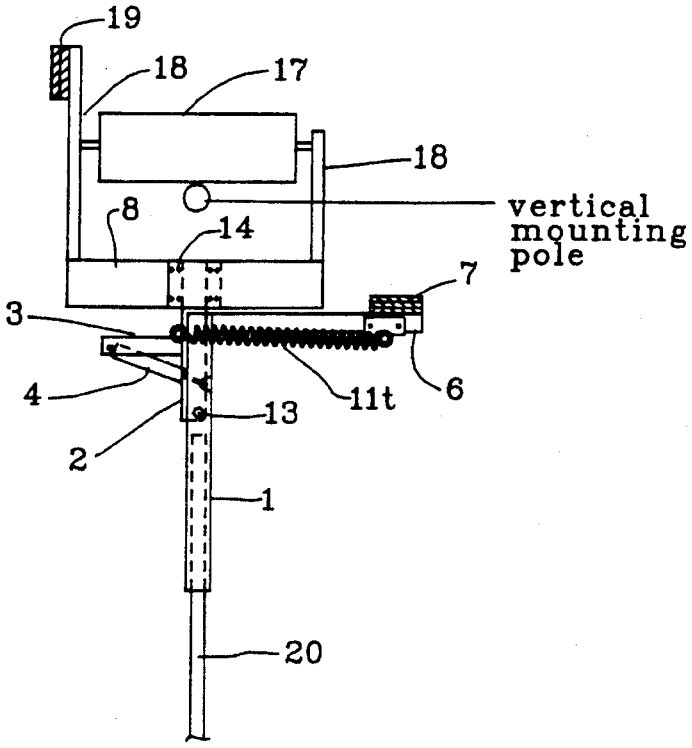
FIG. 5*a* and FIG. 5*b* are expanded rough drawings of a top plan view showing the overall Gate crossing system and its relationship to the invention being presented.
Figure 5B:
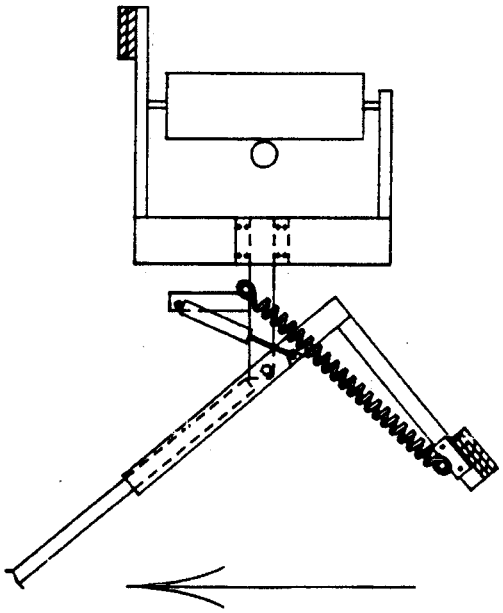
Figure 6:
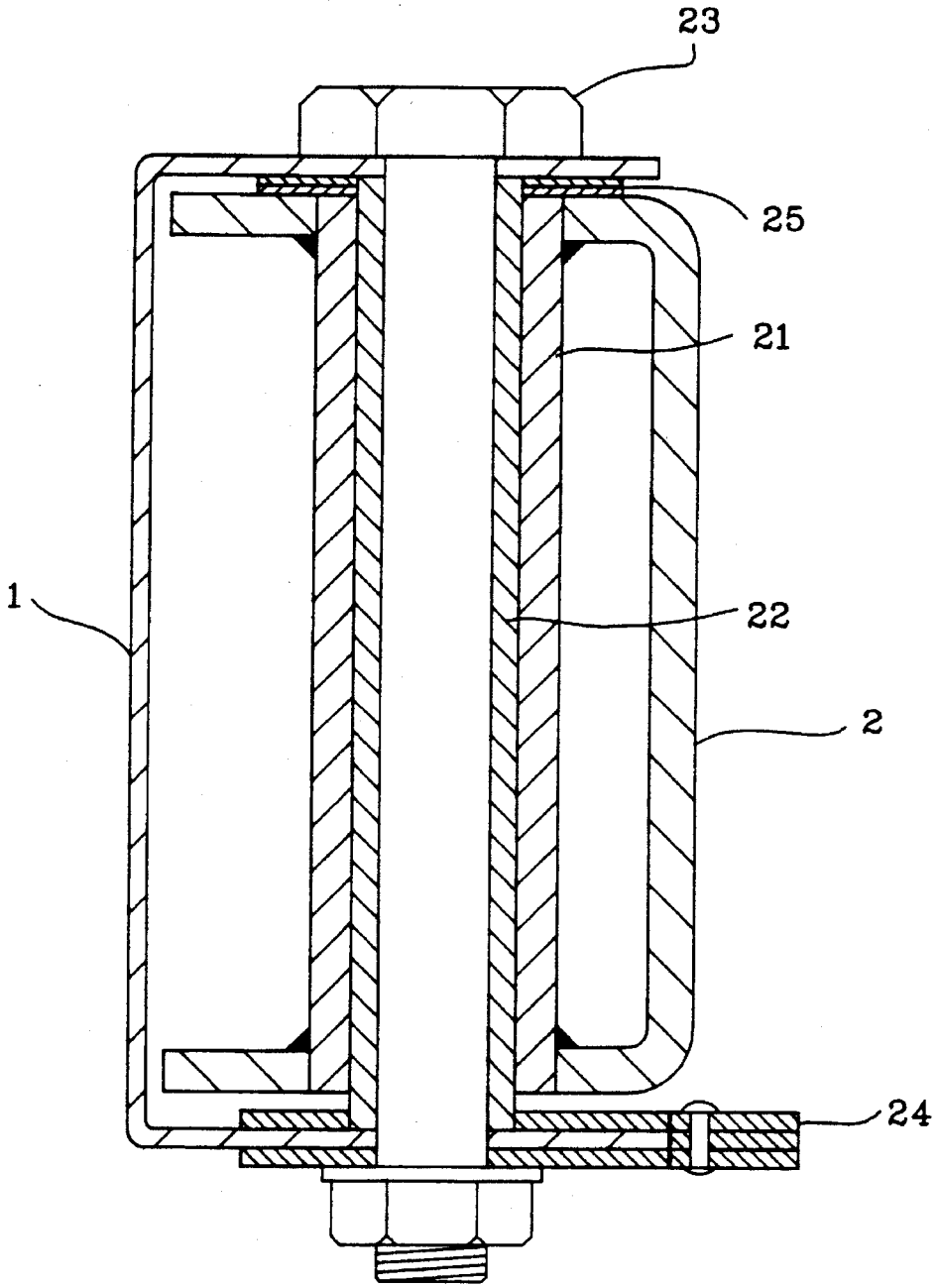
FIG. 6 is a view taken along section line D—D in FIG. 1 showing the pivot assembly comprised of an outer stationary bearing 21 made from stainless steel tubing and welded to the Main Support Channel 2. An inner rotating bearing 22, made from stainless steel tubing, is compressed in place by a stainless steel bolt 23. A locking device 24 insures the integrity of the pivot function.

The Main Support Channel 2, FIG. 5 is attached to the Gate Mechanism 17 operating arms 18 by means of an adapter 8. The Gate Mechanism's operating arms are designed with an offset, so that when the Gate-arm is in the vertical inactive position, a main Counterweight 19 on the opposite end of one of the Gate Mechanism's operating arms maintains the Gate-arm in the vertical position by gravity. Conversely, when the Gate-arm is in the down and horizontal position, the weight of the long gate-arm , with its center of gravity located so as to produce a mechanical advantage over that of the main counter weight 19, the Gate-arm 20 will remain in the horizontal position also by gravity until the Gate Mechanism is again activated to mechanically lift the Gate-arm 20 to a point where the Main Counterweight 19 takes over and holds the Gate-arm in the vertical position again.

This battery power and gravity system is used to conserve power. Therefore, when the Gate-arm is in the horizontal position the Weight 7, FIGS. 1,3, and 5 located on the Spring and Weight Channel 6, is used to automatically correct the imbalance which occurs when the Gate-arm is pushed out of position causing its center of gravity, relative to its normal position, to be altered.

I claim:

1. In a railroad crossing gate arm having a counterweight and gate operating mechanism therefor wherein a self restoring gate arm system is displaced by a moving vehicle from its original position perpendicular to the movement of vehicular traffic and a means to restore said gate arm to its original position after being released by the vehicle, the improvement comprising a means to control the speed of return of said gate arm to its original position at a rate that would prevent damage or injury to following vehicular or pedestrian traffic within the area of return, and a means to automatically compensate for the imbalance created when said gate arm is displaced causing a shift in its center of gravity, where at a particular point of displacement, would cause the gate mechanism counterweight to lift the gate arm prematurely placing said gate arm in an abnormal position and possibly preventing the gate arm from returning to its original position.

* * * * *